US008757418B2

(12) United States Patent
Zimmerman et al.

(10) Patent No.: US 8,757,418 B2
(45) Date of Patent: Jun. 24, 2014

(54) SELF-ANCHORING LOW-PROFILE CONTAINER ANCHOR WITH DIRECTIONAL RELEASE AND ATTACHMENT CAPABILITY

(71) Applicant: Israel Harry Zimmerman, Los Angeles, CA (US)

(72) Inventors: Israel Harry Zimmerman, Los Angeles, CA (US); Paul Dowd, Scarsdale, NY (US)

(73) Assignee: Israel Harry Zimmerman, Los Angeles, CA (US)

( * ) Notice: Subject to any disclaimer, the term of this patent is extended or adjusted under 35 U.S.C. 154(b) by 17 days.

(21) Appl. No.: 13/666,907

(22) Filed: Nov. 1, 2012

(65) Prior Publication Data

US 2014/0117031 A1 May 1, 2014

(51) Int. Cl.
*B65D 25/24* (2006.01)
*A47G 29/093* (2006.01)

(52) U.S. Cl.
CPC ..... *A47G 29/093* (2013.01)
USPC ..... 220/483; 220/630; 220/737; 248/346.11; 248/362; 248/309.3; 248/205.8

(58) Field of Classification Search
CPC ..... B65D 2313/06
USPC ..... 248/310, 346.11, 205.8, 311.2, 362, 248/363, 205.5, 309.3, 683; 220/495.04, 220/737, 739, 630, 636, 634, 483
See application file for complete search history.

(56) References Cited

U.S. PATENT DOCUMENTS 1,518,943 A 12/1924 Story
1,753,611 A 4/1930 Lower
1,778,175 A 10/1930 Thune
1,840,400 A 1/1932 Lebherz
2,083,299 A 6/1937 Hunter
2,233,870 A * 3/1941 Muter ..... 248/205.8
2,565,793 A 8/1951 Weismantel
2,601,279 A 6/1952 Hacus (Continued)

FOREIGN PATENT DOCUMENTS

DE 3742636 1/1989
JP 2003501315 1/2003

(Continued)

OTHER PUBLICATIONS

PCT/ISA, International Search Report/Written Opinion of the International Searching Authority, Counterpart PCT Application No. PCT/US2013/067784, Feb. 17, 2014, 11 pages.

*Primary Examiner* — Terrell McKinnon
*Assistant Examiner* — Daniel J Breslin
(74) *Attorney, Agent, or Firm* — Walter W. Duft

(57) ABSTRACT

A self-anchoring, low profile container anchor with directional release and attachment capability comprises a lower base member, an upper movable member adapted for attachment to a container, and a seal member on the base member. The seal member is configured to engage an external reference surface and form a substantially airtight seal therewith that defines a periphery of a controlled pressure zone. A sealing valve disposed on a valve seat is operably connected to the movable member for lifting off the valve seat and vent the controlled pressure zone when the movable member is raised a first predetermined distance. However, the movable member can tilt a second predetermined tilting distance without the sealing valve lifting off the valve seat, thus providing tilt resistance.

21 Claims, 7 Drawing Sheets

(56) References Cited

U.S. PATENT DOCUMENTS

| | | | | |
|---|---|---|---|---|
| 2,740,545 | A | 9/1956 | Bates | |
| 2,782,948 | A | 2/1957 | Steinberg | |
| 2,839,260 | A | 6/1958 | Jacobi, Jr. | |
| 2,895,636 | A | 7/1959 | Martin | |
| 2,908,473 | A | 10/1959 | Snyder | |
| 2,910,264 | A | 10/1959 | Lindenberger | |
| 2,932,119 | A | 4/1960 | Borah | |
| 2,936,139 | A | 5/1960 | Lindstrom | |
| 2,963,256 | A | 12/1960 | Borah | |
| 2,968,888 | A * | 1/1961 | Borah | 248/346.11 |
| 3,094,235 | A | 6/1963 | Lunning | |
| 3,159,370 | A | 12/1964 | Rubinstein | |
| 3,383,001 | A | 5/1968 | Wei | |
| 3,675,886 | A | 7/1972 | Kampmier | |
| 3,847,324 | A | 11/1974 | Uchanski et al. | |
| 4,040,549 | A | 8/1977 | Sadler | |
| 4,127,211 | A | 11/1978 | Zerbey | |
| 4,133,575 | A * | 1/1979 | Mader | 296/95.1 |
| 4,137,356 | A | 1/1979 | Shoemaker et al. | |
| 4,726,553 | A | 2/1988 | Wischusen, III | |
| 4,756,497 | A | 7/1988 | Lan | |
| 4,759,525 | A | 7/1988 | Cross et al. | |
| 4,760,987 | A | 8/1988 | Lan | |
| 4,836,488 | A | 6/1989 | Ross | |
| 4,872,721 | A | 10/1989 | Sniadach | |
| 4,890,760 | A | 1/1990 | Nicoll, Sr. et al. | |
| 4,928,848 | A | 5/1990 | Ballway | |
| 4,940,138 | A | 7/1990 | Hornstein | |
| 4,941,635 | A | 7/1990 | Lan | |
| 4,955,493 | A | 9/1990 | Touzani | |
| 4,978,566 | A | 12/1990 | Scheurer et al. | |
| 5,040,719 | A | 8/1991 | Ballway | |
| 5,065,973 | A | 11/1991 | Wang | |
| 5,071,096 | A | 12/1991 | Hartman et al. | |
| 5,076,527 | A | 12/1991 | Yung-Huei | |
| 5,133,524 | A | 7/1992 | Liu | |
| 5,180,132 | A | 1/1993 | Pearson et al. | |
| 5,186,350 | A | 2/1993 | McBride | |
| 5,192,043 | A | 3/1993 | Fa | |
| 5,207,076 | A | 5/1993 | Sciarrillo | |
| 5,273,182 | A | 12/1993 | Laybourne | |
| 5,282,541 | A | 2/1994 | Chen | |
| 5,292,140 | A | 3/1994 | Laing | |
| D357,170 | S | 4/1995 | Wellsfry | |
| 5,413,302 | A | 5/1995 | Ferster | |
| 5,511,752 | A | 4/1996 | Trethewey | |
| 5,531,353 | A | 7/1996 | Ward et al. | |
| 5,667,180 | A | 9/1997 | Duckworth | |
| 5,742,971 | A | 4/1998 | Salinger | |
| D397,915 | S | 9/1998 | McNaughton | |
| D400,763 | S | 11/1998 | Taylor et al. | |
| 5,992,806 | A * | 11/1999 | Adams | 248/205.8 |
| 6,000,575 | A | 12/1999 | LaCour et al. | |
| 6,039,206 | A | 3/2000 | DeFrancesco | |
| 6,059,138 | A | 5/2000 | Labruyere | |
| D439,116 | S | 3/2001 | White | |
| 6,264,054 | B1 | 7/2001 | Miyake et al. | |
| 6,315,153 | B1 | 11/2001 | Osborn | |
| 6,318,683 | B1 * | 11/2001 | Savoy | 248/146 |
| 6,367,652 | B1 | 4/2002 | Toida et al. | |
| 6,439,418 | B1 | 8/2002 | Immerman et al. | |
| 6,491,265 | B2 | 12/2002 | Tracy | |
| 6,497,394 | B1 | 12/2002 | Dunchock | |
| 6,511,031 | B2 | 1/2003 | Lin | |
| 6,520,368 | B1 | 2/2003 | Chiu | |
| 6,543,637 | B1 | 4/2003 | Osborn | |
| 6,571,976 | B1 | 6/2003 | Sonnabend | |
| 6,596,374 | B1 | 7/2003 | Adjeleian | |
| 6,666,420 | B1 * | 12/2003 | Carnevali | 248/205.8 |
| 6,745,987 | B2 | 6/2004 | Rousselet et al. | |
| 6,776,368 | B1 | 8/2004 | Duncan et al. | |
| 6,895,642 | B2 * | 5/2005 | Huang | 24/303 |
| 7,090,183 | B2 | 8/2006 | Heybl et al. | |
| 7,201,285 | B2 | 4/2007 | Beggins | |
| 7,306,113 | B2 | 12/2007 | El-Saden et al. | |
| 7,458,541 | B1 * | 12/2008 | Chang | 242/597.7 |
| 7,481,329 | B2 * | 1/2009 | Camp, Jr. | 220/729 |
| 7,726,715 | B2 | 6/2010 | Nagasawa et al. | |
| 8,025,169 | B2 | 9/2011 | Zimmerman | |
| 8,028,850 | B2 | 10/2011 | Zimmerman | |
| 2002/0130133 | A1 | 9/2002 | Immerman et al. | |
| 2003/0102320 | A1 | 6/2003 | Park | |
| 2004/0238541 | A1 | 12/2004 | Camp, Jr. | |
| 2004/0238542 | A1 | 12/2004 | Camp, Jr. et al. | |
| 2006/0175506 | A1 | 8/2006 | Lan | |
| 2007/0012706 | A1 | 1/2007 | Deadman | |
| 2007/0205205 | A1 | 9/2007 | Kliewer | |
| 2008/0093370 | A1 | 4/2008 | Darsey | |
| 2008/0190948 | A1 | 8/2008 | Sayasithsena | |
| 2009/0250467 | A1 | 10/2009 | Schmidt | |
| 2009/0256043 | A1 | 10/2009 | Lan | |

FOREIGN PATENT DOCUMENTS

| | | |
|---|---|---|
| JP | 2004160079 | 10/2004 |
| JP | 2006314739 | 11/2006 |
| WO | W02012008942 | 1/2012 |

* cited by examiner

SELF-ANCHORING LOW-PROFILE CONTAINER ANCHOR WITH DIRECTIONAL RELEASE AND ATTACHMENT CAPABILITY

BACKGROUND

1. Field

The present disclosure relates to containers for holding liquids, semi-liquids, solids or semi-solids. More particularly, the disclosure concerns the prevention of container tipping and consequent content spillage. Still more particularly, the disclosure pertains to anti-tipping technology for beverage containers, such as mugs, glasses and bowls.

2. Description of the Prior Art

By way of background, commonly-owned U.S. Pat. Nos. 8,025,169 and 8,028,850 of Zimmerman disclose self-anchoring beverage containers with directional release and attachment capability. Disclosed embodiments of the '169 and '850 allow a beverage container to remain affixed to a reference surface, thereby resisting tipping and spillage, except when lifted in a normal manner for drinking. In that case, the beverage containers can be removed from the reference surface without discernible resistance, and may thereafter be returned to their original rest position with no unusual manipulation being required for re-seating. The present disclosure is directed to additional self-anchoring constructions that also exhibit directional release and attachment capability for retaining many different types of containers that hold spillable contents.

SUMMARY

A self-anchoring, low profile container anchor with directional release and attachment capability is disclosed. In an example embodiment, the container anchor comprises a container support assembly having a lower base member and an upper movable member. The base member has a peripheral sidewall and an interior structure. The movable member is disposed on an upper side of the base member interior structure. It has an upper side configured for attachment to a container, and a lower side. The movable member is configured to operably connect to the base member. A seal member is disposed on a lower side of the base member interior structure. The seal member has a lower side configured to engage an external reference surface and form a substantially airtight seal therewith that defines a periphery of a controlled pressure zone between the seal member and the reference surface. A valve seat is disposed in container support assembly, and is in fluid communication with the seal member lower side. A sealing valve is disposed on the valve seat. The sealing valve is operably connected to the movable member for lifting off the valve seat when the movable member is raised. The sealing valve and the movable member are operably interconnected in a manner that requires the movable member to lift past a first predetermined distance before the sealing valve begins to lift off the valve seat. As stated, the base member and the movable member are also operably interconnected. This operable interconnection is implemented in a manner that allows the movable member to tilt a second predetermined tilting distance relative to the base member without the sealing valve lifting off the valve seat, and to prevent the movable member from tilting beyond the predetermined tilting distance. When the sealing valve is lifted from the valve seat due to the movable member being raised past the first predetermined distance, the controlled pressure zone is vented to atmospheric pressure. On the other hand, the controlled pressure zone is maintained when the movable member is tilted the second predetermined distance.

In another embodiment, an assembly comprising a container mounted to a self-anchoring, low profile container anchor with directional release and attachment capability is disclosed.

In a further embodiment, a self-anchoring, low profile container anchor with directional release and attachment capability comprises a container support assembly having a lower base member and an upper movable member. The base member has a peripheral sidewall and an interior structure. The movable member is disposed on an upper side of the base member interior structure. It has an upper side configured for attachment to a container, and a lower side. The movable member is configured to operably connect to the base member. A seal member is disposed on a lower side of the base member interior structure. The seal member has a lower side configured to engage an external reference surface and form a substantially airtight seal therewith that defines a periphery of a controlled pressure zone between the seal member and the reference surface. A valve seat is disposed in container support assembly, and is in fluid communication with the seal member lower side. A sealing valve is disposed on the valve seat. The sealing valve is operably connected to the movable member for lifting off the valve seat when the movable member is raised. The movable member and the seal member are nested entirely within an area defined by a periphery of the base member.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
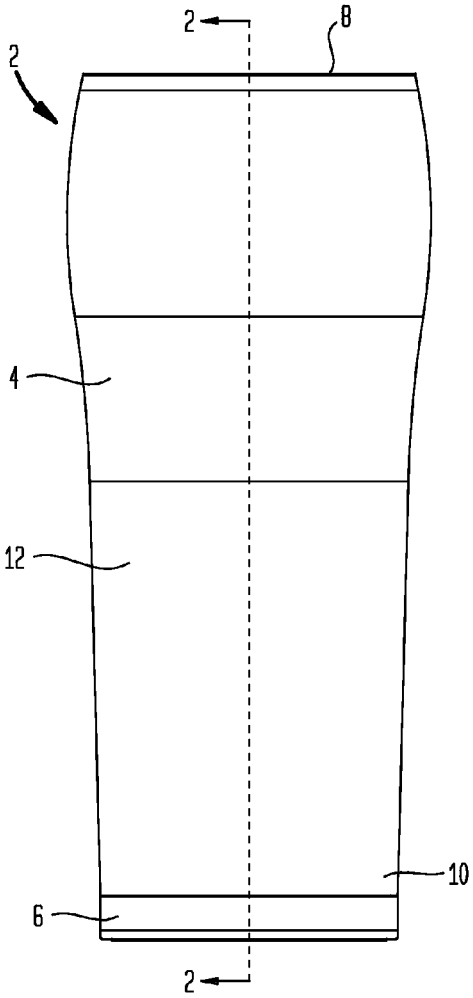
FIG. 1 is a side elevation view of a self-anchoring container assembly.
Figure 2:
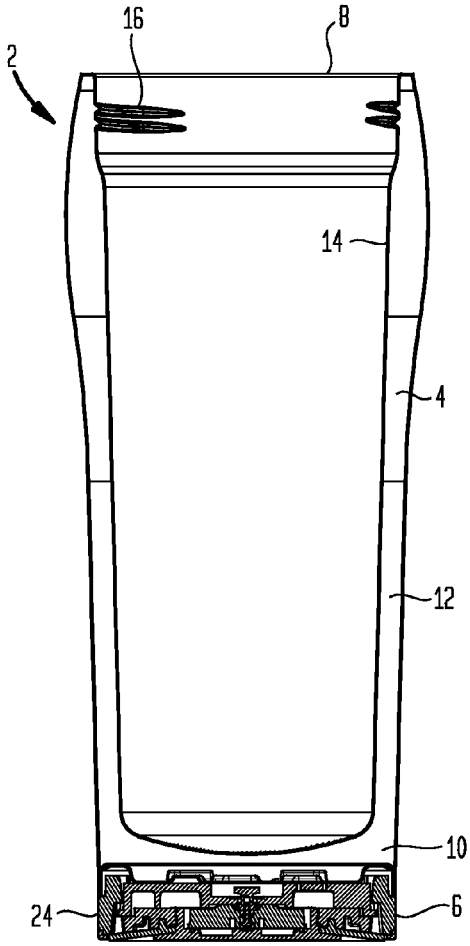
FIG. 2 is cross-sectional view taken along line 2-2 in FIG. 1.

Turning now to the drawing figures, in which like reference numbers illustrate like structure in all of the several views, FIGS. 1 and 2 illustrate one possible embodiment a self-anchoring container assembly 2 that may be constructed in accordance with the present disclosure. The container assembly 2 includes a container 4 mounted on a self-anchoring, low profile container anchor 6 having directional release and attachment capability. As described in more detail below, the container anchor 6 is designed to self-bias the container assembly 2 to a reference surface (such as a table top) by establishing and maintaining a controlled pressure zone that generates a partial vacuum to resist tipping when a side load is applied to the container 4. On the other hand, the self-biasing will be released surreptitiously and the container assembly 2 will lift away from the reference surface without discernible resistance when the container 4 is grasped and maneuvered vertically during normal lifting thereof.

In the illustrated embodiment, the container 4 is implemented as a beverage container having an open top 8, a closed bottom 10, a sidewall 12, and a beverage holding interior 14. This type of beverage container is commonly known as a travel mug, and may have threads 16 proximate to the top 8 for removably attaching a lid (not shown). As also shown, the outer surface of the sidewall 12 may be ergonomically tapered for user convenience, such as by creating a bulge near the top 8. It will be appreciated that the container 4 could be embodied in many other shapes and sizes to provide different types of containers, including but not limited to bowls, buckets, cans, vases, urns, tanks, or any other receptacle apparatus whose function is to hold various types of spillable contents, such as liquids, semi-liquids, solids or semi-solids. The container 4 could also be a container device that holds another container, such as a can or bottle holder that holds a beverage can or bottle.

Figure 3:
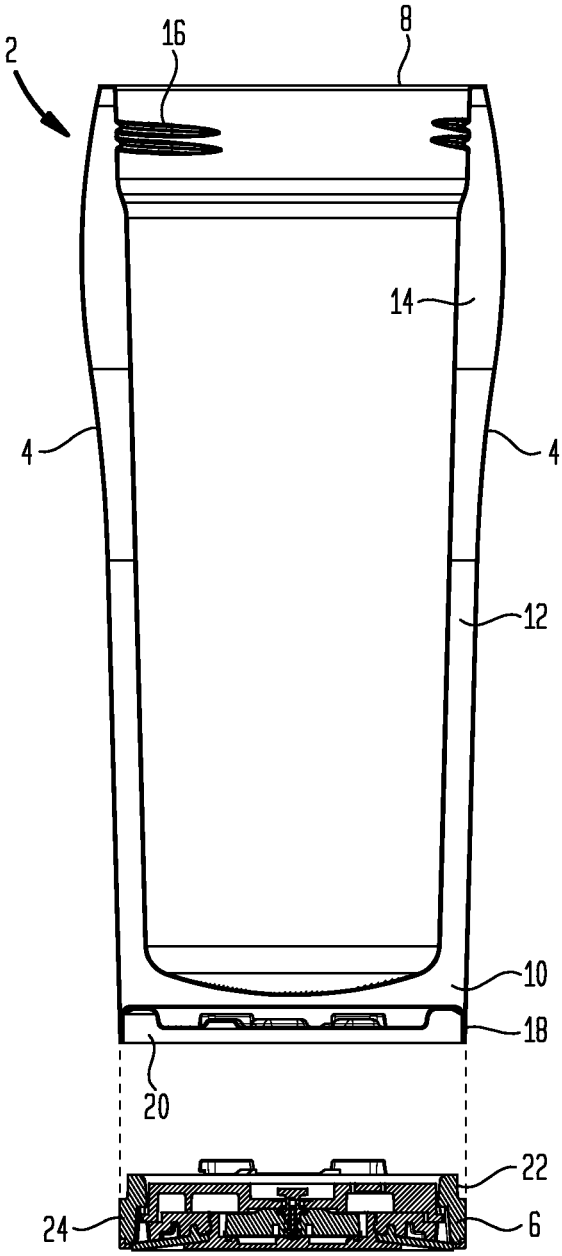
FIG. 3 is exploded cross-sectional view taken along line 2-2 in FIG. 1 showing a low-profile self-anchoring container anchor and a container, representing components of the container assembly of FIG. 1.

As additionally shown in FIG. 3, the bottom 10 of the container 4 may include a specially designed attachment plate 18 that is configured for attachment to the top of the container anchor 6. An example configuration of the attachment plate 18 is described in more detail below. It may be attached to the container bottom 10 as a separate component, or may be integrally formed therewith. In the illustrated embodiment, the attachment plate 18 is a separate component that is received in a hollow recess formed at the lowermost end of the container 4. The attachment plate 18 defines a shallow well 20 that slidably receives a top peripheral side surface portion 22 of the container anchor 6, such that the container anchor is partially nested therein. As can be further seen in FIGS. 1 and 2, the width of the bottom 10 of the container 4 is substantially the same as the width of the container anchor 6 at a bottom peripheral side surface portion 24 thereof that is below the top portion 22, thereby providing a sleek appearance in which the viewer sees the container anchor 6 as part of the container 4.

Figure 4:
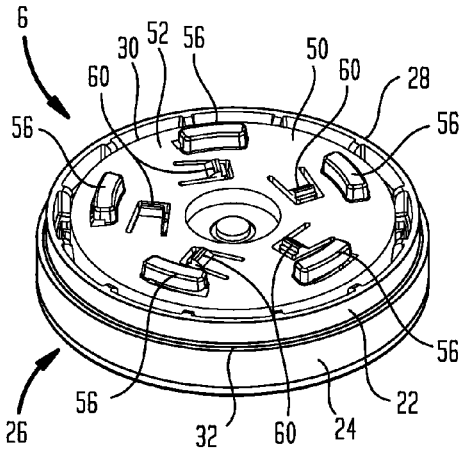
FIG. 4 is a top perspective view of the container anchor of FIG. 3.
Figure 5:
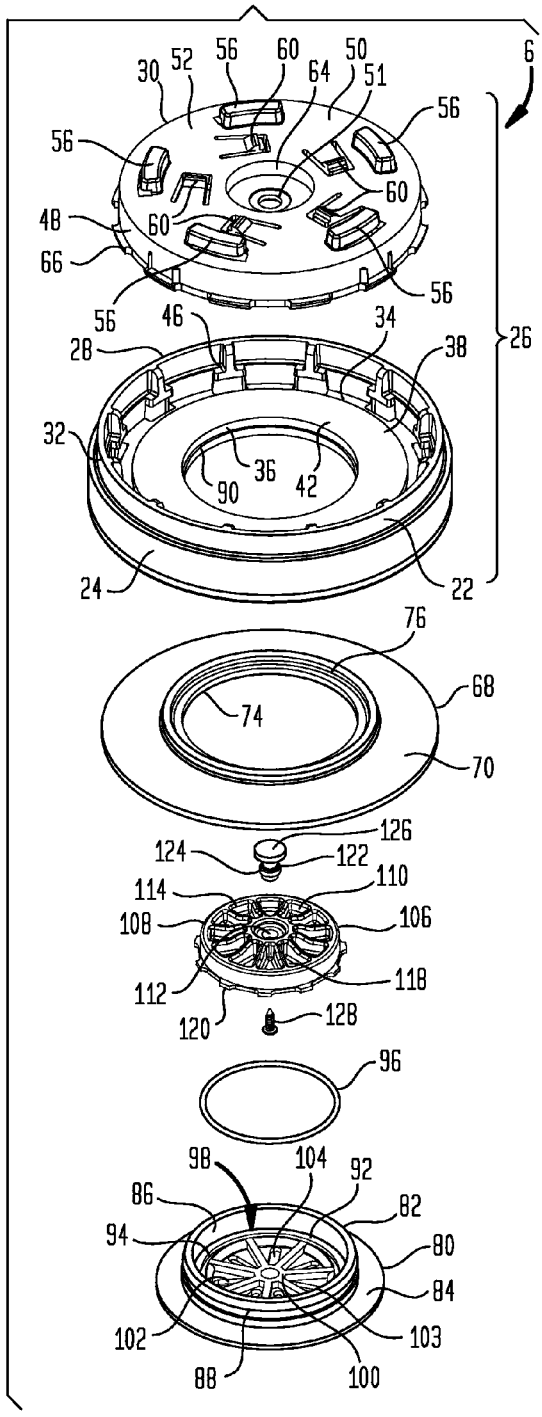
FIG. 5 is an exploded top perspective view of the container anchor of FIG. 3.
Figure 6:
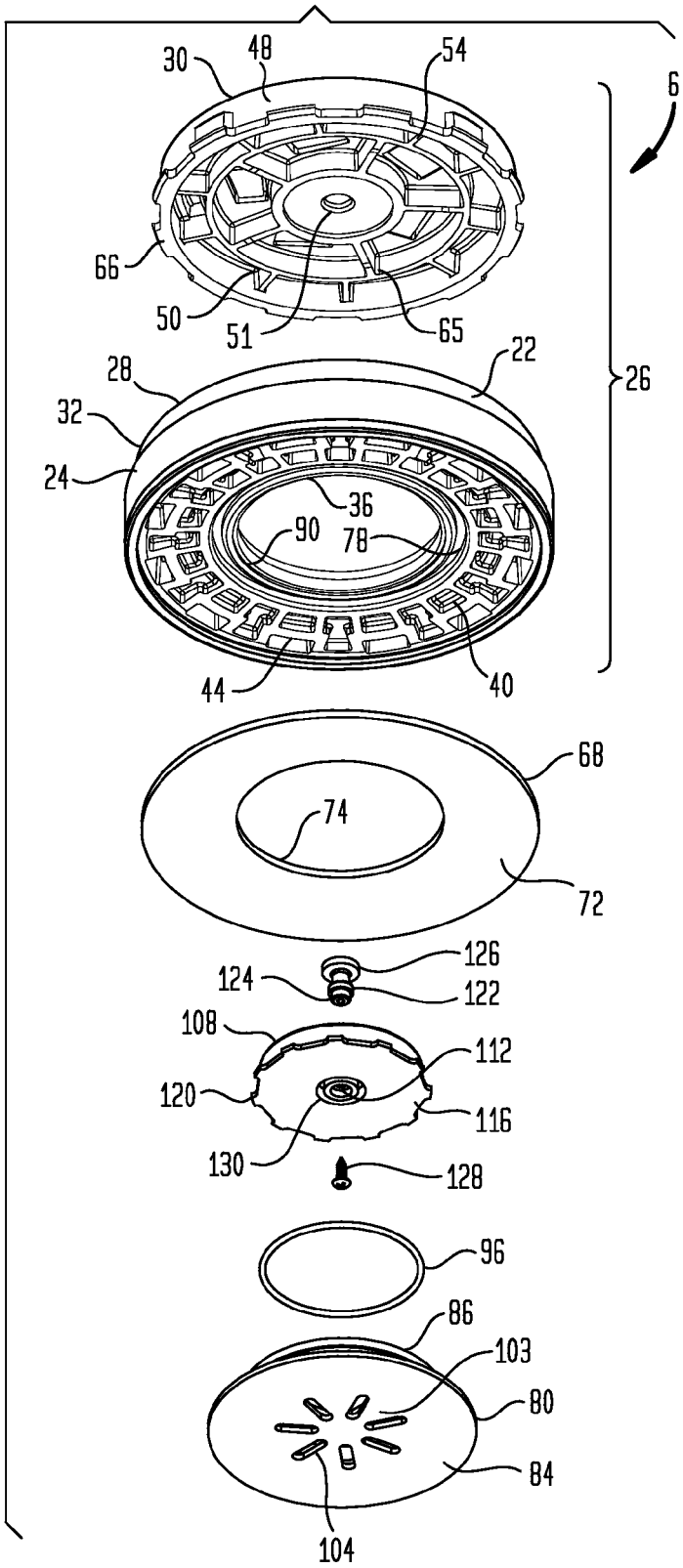
FIG. 6 is an exploded bottom perspective view of the container anchor of FIG. 3.

With additional reference now to FIGS. 4-6, the container anchor 6 is shown in more detail according to one possible embodiment thereof. Unless otherwise indicated, all components of the container anchor 6 may be fabricated from a suitably rigid structural material, such as plastic. As shown at the top of FIGS. 5 and 6, the main load-bearing portion of the container anchor 6 comprises a support assembly 26 that includes a lower base member 28 and an upper movable member 30. In the illustrated embodiment, the support assembly 26 is configured as a generally disk-shaped puck assembly having an appearance that somewhat resembles a hockey puck. It will be appreciated that other configurations may also be used for the support assembly 22, and that it need not be generally-disk shaped or resemble a puck. As shown in FIG. 4, the outer periphery of the movable member 30 is nested entirely within the area defined by the periphery of the base member 28, which facilitates compact design. Non-nested configurations could also be used, such that the periphery of the movable member 30 might extend beyond the periphery of the base member 28 in some implementations.

The periphery of the base member 28 is defined by a peripheral sidewall 32. The base member 28 also has an interior structure 34 extending inwardly from the sidewall 32. The base member sidewall 32 is generally ring-shaped and its outer face forms the top and bottom side surface portions 22 and 24 described above in connection with FIGS. 1-3. The base member interior structure 34 is generally annular in shape, and includes a central aperture 36 that is generally circular in shape. The base member interior structure 34 defines a base member upper side 38 (see FIG. 5) and a base member lower side 40 (see FIG. 6). The base member upper side 38 may be formed with a raised, support ring structure 42 that surrounds the central aperture 36. The base member lower side 40 may be formed with a pattern of gusset members 44 to increase structural stiffness. The inside surface of the base member sidewall 32 may be formed with a set of peripheral stop members 46, which are used to operably connect the base member 28 to the movable member 30, as described in more detail below.

Figure 7:
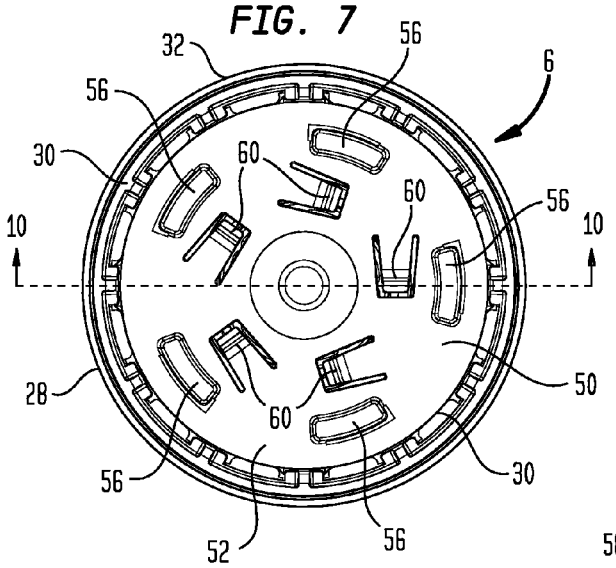
FIG. 7 is a top plan view of the container anchor of FIG. 3.
Figure 8:
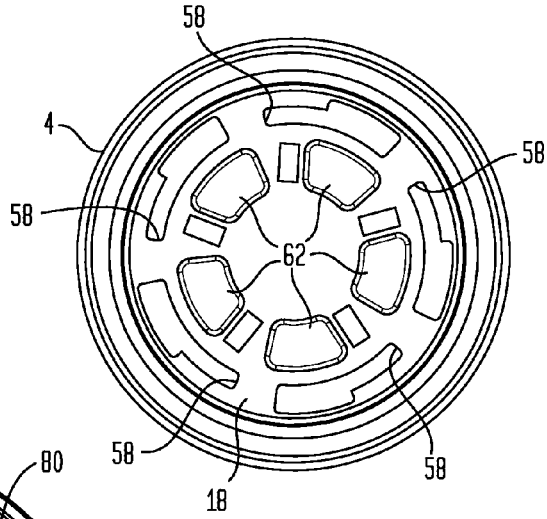
FIG. 8 is a bottom plan view of the container of FIG. 3 showing an attachment plate thereof.

The movable member 30 is disposed on the base member upper side 38. In the illustrated embodiment, the movable member 30 has a peripheral sidewall 48 and an interior structure 50 that extends inwardly from the sidewall and is formed with a central opening 51. The movable member interior structure 50 defines a movable member upper side 52 (FIG. 5) that is configured for attachment to the container 4, and a movable member lower side 54 (FIG. 6) that rests on the base member support ring structure 42. The movable member upper side 52 may be formed with a set of clasps 56 (also shown in FIG. 7) that engage corresponding receiver slots 58 formed on the container attachment plate 18 (as shown in FIG. 8). This provides a bayonet-clip connection capability between the container 4 and the container anchor 6. Retention force biasing is provided by a set of bendable spring tabs 60 on the movable member upper side 52 that are deflected by corresponding protrusions 62 formed on the container attachment plate 18 (see FIG. 8). Other connection arrangements could also be used to secure the movable member 30 to the container attachment plate 18.

The movable member upper side 52 is formed with a central well 64 that surrounds the central opening 51. The movable member lower side 50 may be formed with a pattern of gusset members 65 to increase structural stiffness. The lower edge of the movable member sidewall 48 is formed with a set of peripheral radially protruding tabs 66. As described in more detail below, the movable member 30 is configured to operably connect to the base member 28 by way of coupling interaction between the movable member's peripheral tabs 66 and the base member's peripheral stop members 46. This coupling arrangement, as well as the manner in which the base member 28 and the movable member 30 are configured to fit together, allows the movable member to both lift vertically and tilt relative to the base member, thereby minimizing binding between these components.

Figure 9:
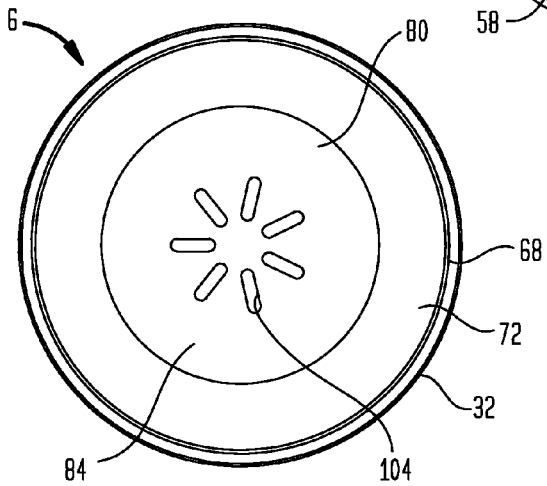
FIG. 9 is a bottom plan view of the container anchor of FIG. 3.
Figure 10:
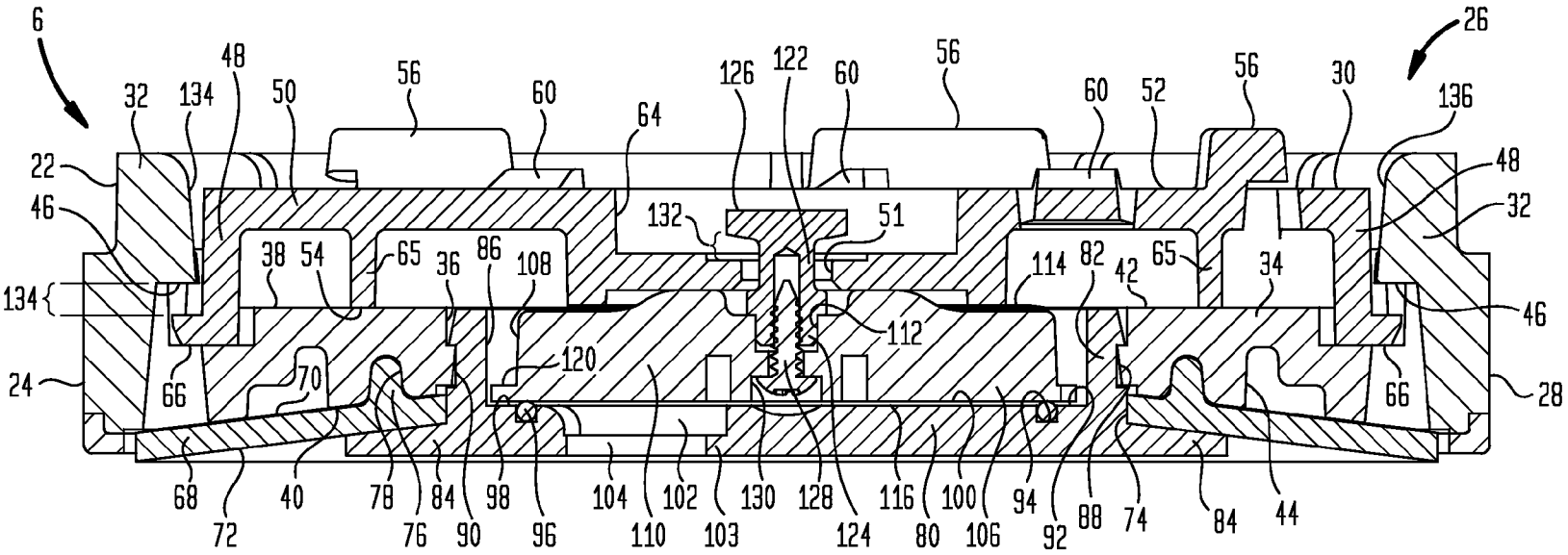
FIG. 10 is an enlarged cross-sectional view taken along line 10-10 in FIG. 7.

A seal member 68 is disposed on the base member lower side 40, and is attached thereto in a manner described in more detail below. The seal member 68 has an upper side 70 (see FIG. 5) and a lower side 72 (see FIG. 6). It is also formed with a central aperture 74 and may be generally annular in shape. As shown in FIG. 9, the seal member 68 may be nested entirely within the area defined by the periphery of the base member 28, which facilitates compact design. However, non-nested configurations could also be used, such that the periphery of the seal member 68 might extend beyond the base member periphery in some implementations. As shown in FIG. 10, the seal member upper side 70 engages the base member lower side 40 in face-to-face relationship. As additionally shown in FIGS. 5 and 6, an upwardly protruding ring 76 surrounding the seal member central aperture 74 is sized to fit into a corresponding ring-shaped groove 78 formed on the base member lower side 40. This helps stabilize the mounting position of the seal member 68. The seal member lower side 72 is configured to engage an external reference surface, such as a table top, and form a substantially airtight seal therewith. An annular contact area where the substantially airtight seal is formed defines the periphery of a controlled pressure zone between the seal member and the reference surface.

The seal member 68 can be attached to the base member lower side 40 by way of a seal retainer 80. The seal retainer 80 has central body 82, with a base flange 84 at its bottom end and a central well 86 at its top end. The seal retainer central body 82 inserts through the seal member central aperture 74, and engages the base member central aperture 36. An annular channel 88 on the seal retainer central body 82 engages an annular shoulder 90 on the side of the base member central aperture 36 in order to interlock these components. As shown in FIG. 10, the bottom of the retainer member central well 86 includes an annular shoulder 92 that is formed with an annular channel 94 to receive an O-ring member 96 made from a suitable resilient material. The annular shoulder 92 and the O-ring 96 define a valve seat 98 in the container support assembly 26. The bottom of the seal retainer central well 86 is further defined by an arrangement of spokes 100 that define vent openings 102. The bottom of each vent opening 102 is defined by a radially interior portion 103 of the seal retainer base flange 84, which is apertured to form a vent slot 104 for each vent opening. The vent openings 102 and the vent slots 104 provide fluid communication between the valve seat 98 and bottom of the retainer member 80. As shown in FIG. 10, this arrangement likewise provides fluid communication between the valve seat 98 and the seal member lower side 72. As also can be seen in FIG. 10, the base member bottom side 40 and the upper side of the seal retainer base flange 84 may be optionally tapered such that the seal member 68, which is sandwiched between these surfaces, forms a frustoconical shape. Advantageously, the seal member 68 does not need to pushed down on and flattened like a standard suction cup would when lowering the container assembly 2 onto a reference surface. Such a pressing action would likely be discernible to a user, which is undesirable. A further configuration option shown in FIG. 10 is to recess the bottom of the seal retainer base flange 84 upwardly away from the lowest point of the seal member 72, which is its outermost peripheral edge in the illustrated embodiment.

A sealing valve 106 is disposed on the valve seat 98, and is operably connected to the movable member 30 so that the sealing valve will lift off the valve seat when the movable member is raised a predetermined distance. The sealing valve 106 may be configured as a generally circular disk member that is large enough in diameter to cover the O-ring 96 on the valve seat 98. In the illustrated embodiment, the sealing valve 106 has a peripheral sidewall 108 and an interior structure 110 that extends inwardly from the sidewall and is formed with a central aperture 112. The sealing valve interior structure 110 defines a sealing valve upper side 114 (FIG. 5), and a sealing valve lower side 116 (FIG. 6). The sealing valve upper side 114 may be formed with a pattern of gusset members 118 that extend radially outwardly from the sealing valve central aperture 112 to increase structural stiffness. As additionally shown in FIG. 10, the sealing valve 106 is slidably disposed within the seal retainer central well 86. A set of optional radially extending peripheral tabs 120 extend from the lower outside edge of the sealing valve sidewall 108. The sealing valve tabs 120 may be provided in order reduce friction with the sides of the seal retainer central well 86. The sealing valve lower side 116 is substantially planar in order to seat on the valve seat O-ring 96 and provide an airtight seal.

The sealing valve 106 and the movable member 30 are operably interconnected by a pin 122. The pin 122 includes a shank portion 124 and an enlarged head flange portion 126. As best shown in FIG. 10, the lower end of the pin shank 124 extends into the sealing valve central aperture 112, and is retained therein by an adjustment screw 128 that threads into the bottom of the shank. The head of the adjustment screw 128 engages a shoulder 130 surrounding the bottom end of the sealing valve central aperture 112. The upper end of the pin shank 124 extends through the movable member central aperture 51, which provides a pin-receiving opening. The pin head flange 126 is captured in the movable member central well 64. It will be seen in FIG. 10 that a gap 132 exists between the bottom of the pin head flange 126 and the bottom of the movable member central well 64. Due to the gap 132, the sealing valve 106 and the movable member 30 are operably interconnected in a manner that requires the movable member to lift past a first predetermined distance (represented by the gap) before the sealing valve begins to lift off the valve seat 98.

Figure 11A:
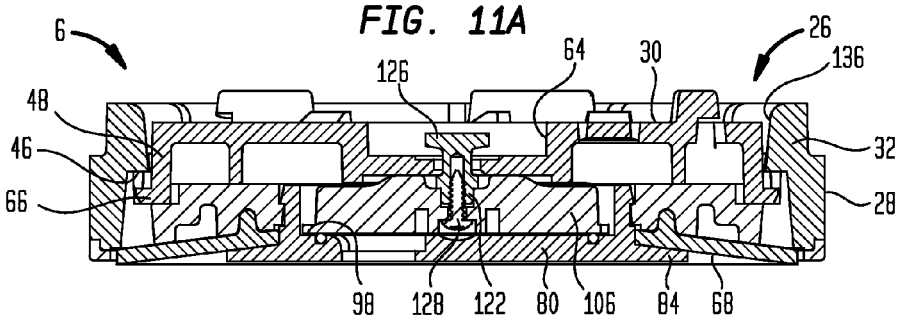
FIG. 11A is a cross-sectional view according to FIG. 10 showing the container anchor in a first operational position.
Figure 11B:
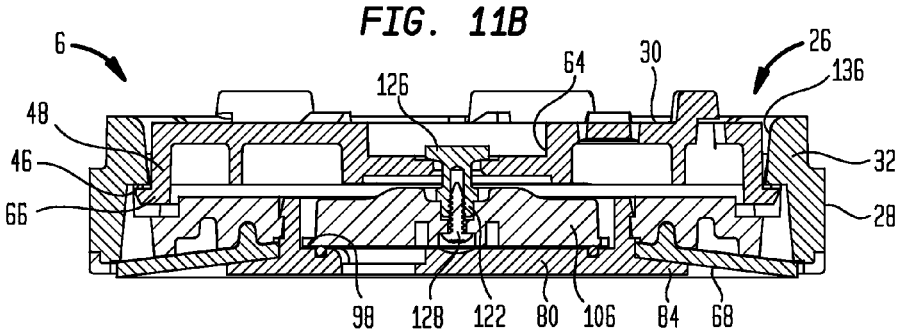
FIG. 11B is a cross-sectional view according to FIG. 10 showing the container anchor in a second operational position.
Figure 11C:
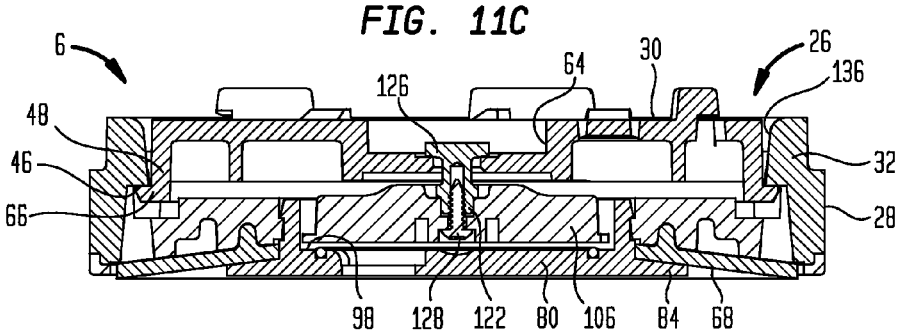
FIG. 11C is a cross-sectional view according to FIG. 10 showing the container anchor in a third operational position.

When the container anchor 6 is in the position shown in FIG. 10, the sealing valve 106 seals against the valve seat 98. The sealing valve upper side 114 is engaged by the movable member lower side 54, so that weight of the container 4 will apply a downward sealing force on the sealing valve. This closes the air pathway that extends through the openings 102 and the apertures 104 in the retainer member 80, and seals the volumetric region between seal member lower side 72 and the reference surface on which the container assembly 2 is supported. The aforementioned controlled pressure zone is thereby established. FIGS. 11A-11D show how the position of the movable member 30 changes during operation of the container assembly 2. Starting from the initial position shown in FIG. 11A, the movable member 30 can be lifted vertically (by grasping and lifting the container 4) through the first predetermined distance to arrive at the position shown in FIG. 11B. Vertically lifting will occur when the container 4 is lifted substantially vertically in a normal manner. In the FIG. 11B position, the bottom of the movable member central well 64 begins to contact the bottom of the pin head 126. Any further lifting of the movable member 30 beyond this point will cause the sealing valve 106 to begin to lift off the valve seat 98. This will vent the controlled pressure zone underneath the seal member 68 to atmosphere. Advantageously, the venting will be substantially instantaneous due to the large surface area of the valve seat 98 and the sealing valve 106. As shown in FIG. 10, these components are approximately one-third the diameter of the base member 28. Larger sizes could also be used. FIG. 11C shows the movable member 30 after it has been lifted through a second predetermined distance 134 (see FIG. 10) to its uppermost limit position relative to the base member 28. This uppermost limit position is reached when the movable member peripheral tabs 66 engage the base member peripheral stop members 46. As may be seen by comparing FIG. 11A to FIG. 11C, the second predetermined distance 134 is thus the maximum distance between the movable member peripheral tabs 66 and the base member peripheral stop members 46. At this point, any further lifting of the movable member 30 will lift the container anchor 6 from the reference surface. Advantageously, the container 4, which is attached to the container anchor 6, can be lifted from the reference surface without any discernible resistance, other than gravity.

Figure 11D:
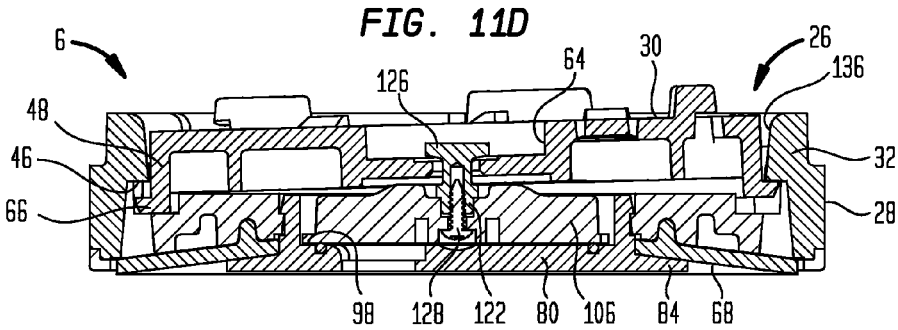
FIG. 11D is a cross-sectional view according to FIG. 10 showing the container anchor in a fourth operational position.

As additionally shown in FIG. 11D, the base member 28 and the movable member 30 are operably interconnected in a manner that allows the movable member to tilt a predetermined tilting distance without the sealing valve 106 lifting off the valve seat 98, and to prevent the movable member from tilting beyond the predetermined tilting distance. This feature allows the container assembly 2 to resist tipping because sub-atmospheric pressure is generated within the controlled pressure zone as soon as the movable member 30 is tilted the predetermined tilting distance. The predetermined tilting distance happens to represent the aforementioned second predetermined distance 134 shown in FIG. 10. Advantageously, an upper inside surface 136 of the base member sidewall 32 is outwardly tapered. This provides room for the movable member 28 to tilt without the movable member sidewall 48 binding against the base member sidewall 32. As shown in FIG. 11D, the maximum tilt position of the movable member 30 is reached when one side of the movable member remains in the initial position shown in FIG. 11A (e.g., the left-hand side in FIG. 11D), while the diametrically opposite side of the movable member is lifted until the movable member peripheral tabs 66 on that side engage the base member peripheral stop members 46 on the same side (e.g., the right-hand side in FIG. 11D). At this point, the base member 28 will begin to experience a tipping force in which one side thereof is pressed downwardly (by the movable member 30) while the diametrically opposite side is urged upwardly (by the movable member 30). This tilting force will be transferred into the attached seal retainer 80, and one side thereof will be pressed downwardly against the reference surface while the diametrically opposite side will be lifted upwardly against the bottom of the seal 68. This will cause the volume within the controlled pressure zone to increase and the pressure therein to decrease in accordance with Boyle's law. Advantageously, by making the base of the seal retainer base flange 84 as wide as possible, the upward force applied to the seal 68 as a result of the aforementioned tilting will be lower than it would be if the seal retainer base flange was narrow. Lowering the upward force applied to the seal 68 is desirable to prevent the seal from dislodging from the reference surface. In the illustrated embodiment, the diameter of the seal retainer base flange 84 is more than one-half the diameter of the base member 28.

By situating the connecting pin 122 at the center of the movable member 30, it will be seen that lifting one side of the movable member by the second predetermined distance 134 will only lift the center of the movable member by one half of that distance. Thus, during tilting, when the movable member 30 is tilted through the predetermined tilting distance in the manner described above, the sealing valve 106 will remain seated on the valve seat 98, and the controlled pressure zone will be maintained. To ensure that the sealing valve 106 is not engaged by the pin 122 when the movable member 30 is in its maximum tilt position, the first predetermined distance 132 may be adjusted by advancing or retracting the adjustment screw 128.

Accordingly, a self-anchoring, low-profile beverage container anchor with directional release and attachment capability has been disclosed. Although example embodiments have been shown and described, it should be apparent that many variations and alternative embodiments could be implemented in accordance with the present disclosure. It is understood, therefore, that the invention is not to be in any way limited except in accordance with the spirit of the appended claims and their equivalents.

What is claimed is:

1. A self-anchoring, low profile container anchor with directional release and attachment capability, comprising:

a container support assembly including a lower base member and an upper movable member;

said base member having a peripheral sidewall and an interior structure;

said movable member being disposed on an upper side of said base member interior structure;

said movable member having an upper side configured for attachment to a container, a lower side, and being configured to operably connect to said base member;

a seal member disposed on a lower side of said base member interior structure;

said seal member having a lower side configured to engage an external reference surface and form a substantially airtight seal therewith that defines a periphery of a controlled pressure zone between said seal member and said reference surface;

a valve seat in said container support assembly, said valve seat being in fluid communication with said seal member lower side;

a sealing valve disposed on said valve seat, said sealing valve being operably connected to said movable member for lifting off said valve seat when said movable member is raised;

said sealing valve and said movable member being operably interconnected in a manner that requires said movable member to lift past a first predetermined distance before said sealing valve begins to lift off said valve seat;

said base member and said movable member being operably interconnected in a manner that allows said movable member to tilt a second predetermined tilting distance without said sealing valve lifting off said valve seat, and to prevent said movable member from tilting beyond said predetermined tilting distance;

whereby when said sealing valve is lifted from said valve seat due to said movable member being raised past said first predetermined distance, said controlled pressure zone is vented to atmospheric pressure; and whereby said controlled pressure zone is maintained when said movable member is tilted said second predetermined distance.

2. The apparatus of claim 1, wherein said sealing valve is operably connected to said movable member by a pin that extends through a pin-receiving opening in said movable member, said pin having a head flange that engages said movable member when said movable member has been lifted said first predetermined distance.

3. The apparatus of claim 2, wherein said pin is vertically adjustable on said sealing valve so that said first predetermined distance can be adjusted.

4. The apparatus of claim 2, wherein said movable member is operably connected to said base member by a set of movable member peripheral tabs that engage a corresponding set of peripheral stops on said base member peripheral sidewall when said movable member has been lifted said second predetermined distance.

5. The apparatus of claim 4, wherein said movable member is sized so that a distance between diametrically opposing pairs of said peripheral tabs is such that tilting said movable member said second predetermined distance will not result in said movable member being raised said first predetermined distance and engaging said head flange.

6. The apparatus of claim 5, wherein there is a single pin operably connecting said valve to said movable member, and wherein said pin-receiving opening is situated equidistantly from said movable member peripheral tabs.

7. The apparatus of claim 1, wherein said movable member is nested entirely within an area defined by said base member peripheral sidewall.

8. The apparatus of claim 1, wherein said seal member is nested entirely within said area defined by said base member peripheral sidewall.

9. The apparatus of claim 1, wherein said container support assembly comprises a generally disk-shaped puck assembly.

10. The apparatus of claim 1, wherein said base member peripheral sidewall is generally ring-shaped, and wherein said base member interior structure is generally annular-shaped with a central aperture that is generally circular in shape.

11. The apparatus of claim 10, wherein said seal member is formed with a central aperture and is generally annular in shape, said seal member being attached to said lower side of said base member interior structure.

12. The apparatus of claim 11, wherein said lower side of said base member interior structure is tapered such that said seal member forms a frustoconical shape.

13. The apparatus of claim 1, wherein said seal member is attached to said lower side of said base member interior structure by way of a seal retainer that inserts through said central aperture in said seal member and engages said central aperture in said base member interior structure.

14. The apparatus of claim 13, wherein said seal retainer includes a central well whose bottom defines said valve seat, and one or more apertures providing an air pathway from said valve seat to a lower side of said seal retainer that is in fluid communication with said seal lower side.

15. The apparatus of claim 14, wherein said valve seat comprises a resilient member mounted on said bottom of said seal retainer central well.

16. The apparatus of claim 15, wherein said sealing valve comprises a generally circular disk member and said resilient seal comprises an O-ring.

17. The apparatus of claim 16, wherein said sealing valve includes peripheral tabs that reduce friction between said sealing valve and a side portion of said seal retainer central well.

18. The apparatus of claim 1, wherein said base member interior structure is a load-bearing structure and said movable member is supported thereon.

19. The apparatus of claim 1, in combination with a container mounted on said movable member to form a container assembly.

20. A self-anchoring, low profile container anchor with directional release and attachment capability, comprising:

a container support assembly including a lower base member and an upper movable member;

said base member having a peripheral sidewall and an interior structure;

said movable member being disposed on an upper side of said base member interior structure;

said movable member having an upper side configured for attachment a container, and a lower side configured to operably connect to said base member;

a seal member disposed on a lower side of said base member interior structure;

said seal member having a lower side configured to engage an external reference surface and form a substantially airtight seal therewith that defines a periphery of a controlled pressure zone between said seal member and said reference surface;

a valve seat in said container support assembly, said valve seat being in fluid communication with said seal member lower side;

a sealing valve disposed on said valve seat, said sealing valve being operably connected to said movable member for lifting off said valve seat when said movable member is raised;

said sealing valve and said movable member being operably interconnected in a manner that requires said movable member to lift past a first predetermined distance before said sealing valve begins to lift off said valve seat; and said movable member and said seal member being nested entirely within an area defined by a periphery of said base member;

whereby when said sealing valve is lifted from said valve seat due to said movable member being raised past said first predetermined distance, said controlled pressure zone is vented to atmospheric pressure and;

wherein said sealing valve is operably connected to said movable member by a pin that extends through a pin-receiving opening in said movable member, said pin having a head flange that engages said movable member when said movable member has been lifted said first predetermined distance.

21. A self-anchoring, low profile container anchor with directional release and attachment capability, comprising:

a container support assembly including a lower base member and an upper movable member;

said base member having a peripheral sidewall and an interior structure;

said movable member being disposed on an upper side of said base member interior structure;

said movable member having an upper side configured for attachment to a container and a lower side configured to operably connect to said base member;

a seal member disposed on a lower side of said base member interior structure;

said seal member having a lower side configured to engage an external reference surface and form a substantially airtight seal therewith that defines a periphery of a controlled pressure zone between said seal member and said reference surface;

a valve seat in said container support assembly, said valve seat being in fluid communication with said seal member lower side;

a sealing valve disposed on said valve seat, said sealing valve being operably connected to said movable member for lifting off said valve seat when said movable member is raised;

said sealing valve and said movable member being operably interconnected in a manner that requires said movable member to lift past a first predetermined distance before said sealing valve begins to lift off said valve seat;

said base member and said movable member being operably interconnected in a manner that allows said movable member to tilt a second predetermined tilting distance without said sealing valve lifting off said valve seat, and to prevent said movable member from tilting beyond said predetermined tilting distance;

whereby when said sealing valve is lifted from said valve seat due to said movable member being raised past said first predetermined distance, said controlled pressure zone is vented to atmospheric pressure;

whereby said controlled pressure zone is maintained when said movable member is tilted said second predetermined distance;

said sealing valve being operably connected to said movable member by a pin that extends through a pin-receiving opening in said movable member, said pin having a head flange that engages said movable member when said movable member has been lifted said first predetermined distance;

said pin being vertically adjustable on said sealing valve so that said first predetermined distance can be adjusted;

said movable member being operably connected to said base member by a set of movable member peripheral tabs that engage a corresponding set of peripheral stops on said base member peripheral sidewall when said movable member has been lifted said second predetermined distance;

said movable member being sized so that a distance between diametrically opposing pairs of said peripheral tabs is such that tilting said movable member said second predetermined distance will not result in said movable member being raised said first predetermined distance and engaging said head flange;

said pin being single pin operably connecting said valve to said movable member, and said pin-receiving opening being situated equidistantly from said movable member peripheral tabs;

said movable member being nested entirely within an area defined by said base member peripheral sidewall;

said seal member being nested entirely within said area defined by said base member peripheral sidewall;

said container support assembly comprising a generally disk-shaped puck assembly;

said base member peripheral sidewall being generally ring-shaped, and said base member interior structure being generally annular-shaped with a central aperture that is generally circular in shape;

said seal member being formed with a central aperture and is generally annular in shape, said seal member being attached to said lower side of said base member interior structure;

said lower side of said base member interior structure being tapered such that said seal member forms a frustoconical shape;

said seal member being attached to said lower side of said base member interior structure by way of a seal retainer that inserts through said central aperture in said seal member and engages said central aperture in said base member interior structure;

said seal retainer including a central well whose bottom defines said valve seat, and one or more apertures providing an air pathway from said valve seat to a lower side of said seal retainer that is in fluid communication with said seal lower side;

said valve seat comprising a resilient member mounted on said bottom of said seal retainer central well;

said sealing valve comprising a generally circular disk member and said resilient seal comprises an O-ring;

said sealing valve including peripheral tabs that reduce friction between said sealing valve and a side portion of said seal retainer central well; and said base member interior structure being a load-bearing structure and said movable member being supported thereon.

* * * * *